US009133991B2

(12) United States Patent
Kunzendorf

(10) Patent No.: US 9,133,991 B2
(45) Date of Patent: Sep. 15, 2015

(54) CYLINDRICAL FLASHLIGHT WITH ANTIROLL DEVICE

(75) Inventor: Andre Kunzendorf, Wuppertal (DE)

(73) Assignee: ZWEIBRUEDER OPTOELECTRONICS GMBH & CO. KG, Solingen (DE)

( * ) Notice: Subject to any disclaimer, the term of this patent is extended or adjusted under 35 U.S.C. 154(b) by 0 days.

(21) Appl. No.: 14/007,204

(22) PCT Filed: May 4, 2012

(86) PCT No.: PCT/DE2012/000470

§ 371 (c)(1),
(2), (4) Date: Sep. 24, 2013

(87) PCT Pub. No.: WO2012/167763

PCT Pub. Date: Dec. 13, 2012

(65) Prior Publication Data

US 2014/0085878 A1 Mar. 27, 2014

(30) Foreign Application Priority Data

Jun. 8, 2011 (DE) ..... 10 2011 103 653

(51) Int. Cl.
*F21L 4/00* (2006.01)
*F21V 15/00* (2015.01)

(52) U.S. Cl.
CPC . *F21L 4/005* (2013.01); *F21L 4/00* (2013.01); *F21V 15/00* (2013.01)

(58) Field of Classification Search
CPC ..... F21L 4/005; F21L 4/00; F21L 4/022; F21L 4/045; F21L 4/085; F21L 7/00; F21L 11/00; F21V 15/00
See application file for complete search history.

(56) References Cited

U.S. PATENT DOCUMENTS

| | | | | |
|---|---|---|---|---|
| 2,253,952 | A | 8/1941 | Desimone | |
| 4,307,439 | A | 12/1981 | Sassmannshausen | |
| 5,165,782 | A | 11/1992 | Maglica | |
| 5,339,229 | A * | 8/1994 | Snyder | 362/208 |
| 7,281,815 | B1 * | 10/2007 | Gustafson et al. | 362/206 |
| 7,309,139 | B2 * | 12/2007 | Au et al. | 362/188 |
| 7,802,898 | B1 * | 9/2010 | Gregory et al. | 362/205 |
| 2003/0133290 | A1 * | 7/2003 | Dickinson | 362/202 |
| 2004/0136185 | A1 * | 7/2004 | Sharrah | 362/202 |
| 2004/0145889 | A1 | 7/2004 | Hendricks | |
| 2011/0164411 | A1 | 7/2011 | Sparing | |

* cited by examiner

*Primary Examiner* — Bao Q Truong
(74) *Attorney, Agent, or Firm* — Andrew Wilford

(57) ABSTRACT

The present invention relates to a cylindrical flashlight and a ring element for use as a roll-away safeguard of a cylindrical flashlight. In order to prevent a cylindrical flashlight from rolling away, the invention proposes a cylindrical flashlight having a ring element that is connected to the flashlight and has radially protruding elevations which have surface sections that are arranged at a distance from the surface of the cylindrical flashlight in some areas in the assembled state. Also proposed is a ring element for use as a roll-away safeguard of a cylindrical flashlight, which can be detachably connected to the flashlight and has radially protruding elevations which have surface sections that are arranged at a distance from the cylindrical surface of the flashlight in the assembled state.

8 Claims, 3 Drawing Sheets

Fig. 1a
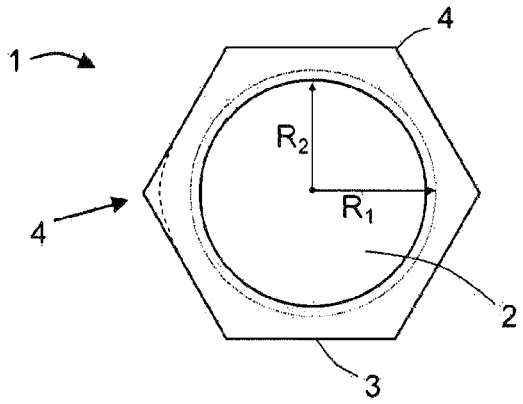
Fig. 1b
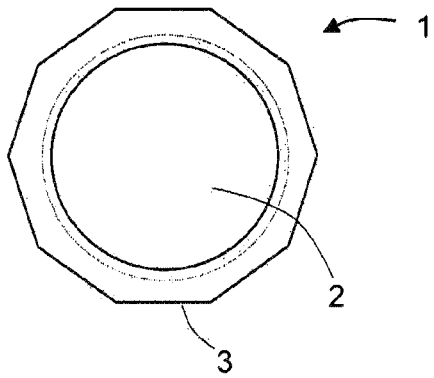
Fig. 1c
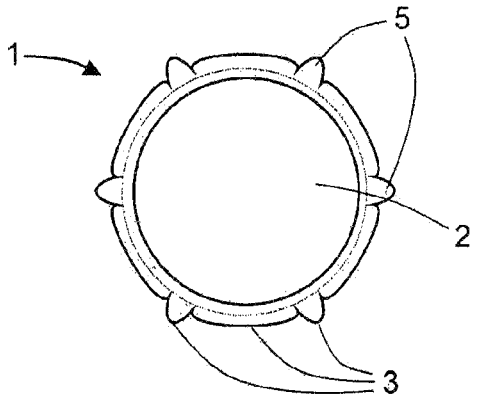
Fig. 1d
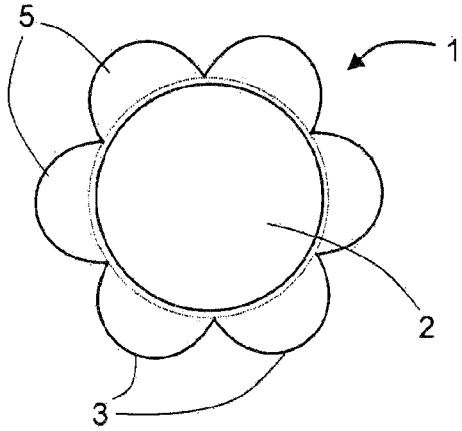
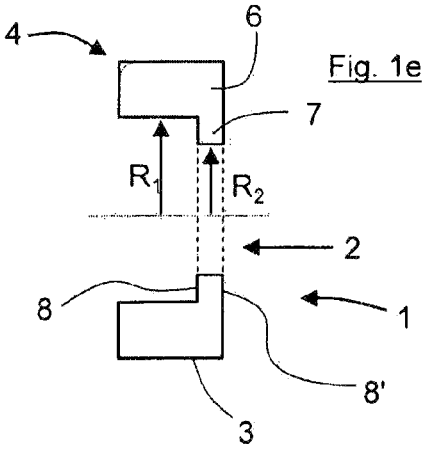
Fig. 1e Fig. 2a
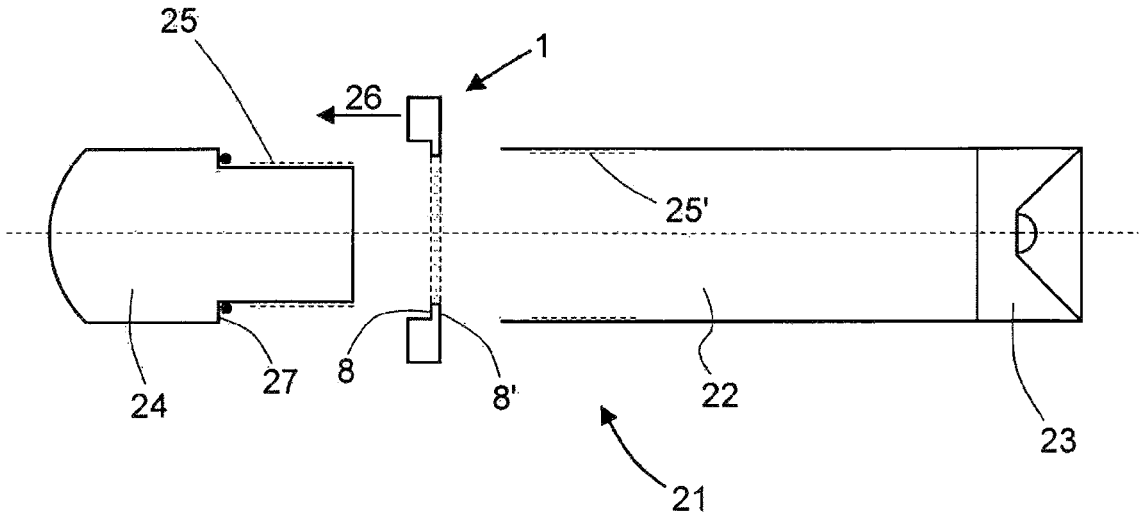
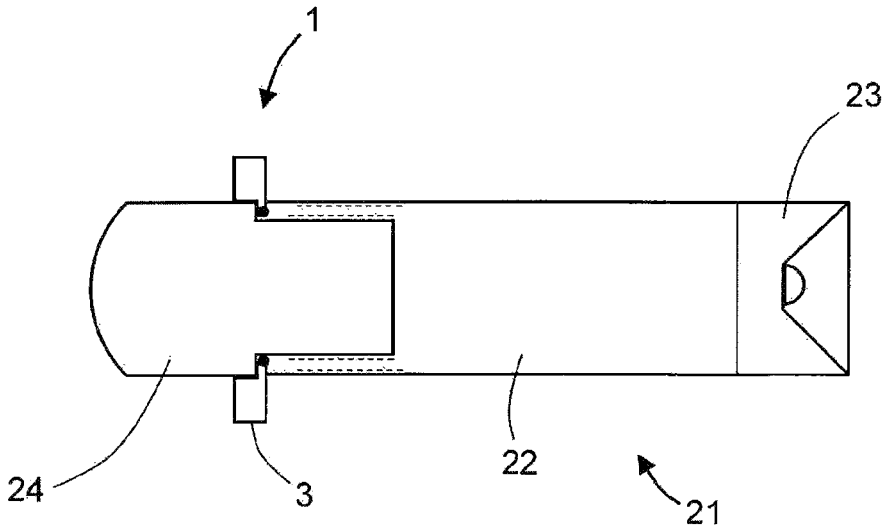
Fig. 2b

CYLINDRICAL FLASHLIGHT WITH ANTIROLL DEVICE

CROSS REFERENCE TO RELATED APPLICATIONS

This application is the US-national stage of PCT application PCT/DE2012/000470 filed 4 May 2012 and claiming the priority of German patent application 102011103653.2 itself filed 8 Jun. 2011.

FIELD OF THE INVENTION

The present invention relates to a cylindrical flashlight and to a ring for use as an antiroll device of a cylindrical flashlight.

Flashlights exist in virtually any design desired. However, cylindrical flashlights have primarily penetrated the market, since, on the one hand, they can be produced simply and, on the other hand, they are very robust because of their design. It has proven particularly practical here to provide the individual component parts of the flashlight, such as the flashlight housing, the end cap and the flashlight head, with interfitting screwthreads so that these parts can be joined together simply and quickly. Furthermore, cylindrical flashlights fit well in the hand and give the user a good haptic feeling.

However, cylindrical flashlights disadvantageously tend to roll away when they are put down on an inclined surface or if they are lying on a shelf in an automobile, train or another means of transportation that is braked or accelerated. For these reasons, the lamp head of the flashlight described in DE 2950850 [U.S. Pat. No. 4,307,439] is formed as an equilateral polygon in order that the flashlight does not roll when laid down. Alternatively, axially extending ribs can also be provided.

The disadvantage with such a configuration is that not every buyer of flashlights needs it for the same intended purpose, so that the asymmetric configuration of flashlights that differs from the cylindrical shape can also be undesired. Above all outdoors, where flashlights are conveyed all day in the rucksack or other packing devices and are used only infrequently, such a flashlight has edges and corners that may damage sensitive material of the other stowed items of baggage. Furthermore, flashlights that have a design differing from a cylindrical shape are comparatively heavier, which has likewise proven to be disadvantageous in particular outdoors, where attention is meanwhile paid to every gram.

For these reasons, many buyers must disadvantageously obtain two different flashlights that are each constructed for different intended purposes, or decide between two flashlights, neither of which is adapted optimally for the intended use.

OBJECT OF THE INVENTION

It is therefore the object of the present invention to devise a possible way of being able to adapt a flashlight to the required conditions and, in particular, to form a flashlight optionally with or without a antiroll device.

SUMMARY OF THE INVENTION

According to a first aspect of the invention, the cylindrical flashlight has at least one ring that is connected to the flashlight and has radially projecting raised formations that have parts that are spaced from the surface of the cylindrical flashlight in some areas in the assembled state.

According to a further aspect of the invention, the ring for use as a antiroll device of a cylindrical flashlight can be detachably connected to the flashlight and has radially projecting raised formations that have parts that are spaced from the cylindrical surface of the flashlight in the assembled state. The parts serve as a contact surface, so that a flashlight with the inventive ring that is laid down cannot roll away unintentionally even if the supporting surface is moved or it is inclined. However, if the user does not use the flashlight for a relatively long time period such that undesired rolling away is to be feared, this user can remove the ring from the flashlight, which restores it to a cylindrical shape. Conversely, the ring can also be fixed to the flashlight quickly again, which means it fulfills its function as a antiroll device.

According to a first preferred refinement of the invention, the flashlight has a flashlight housing that, at the rear, is detachably connected to an end cap and/or, at the front, is detachably connected to a lamp head, the end cap and/or the lamp head being preferably connected to the flashlight housing by a threaded connection. Alternatively or in addition to this, the lamp head can also be connected indirectly to the flashlight housing via a lamp head neck, where a threaded connection is likewise preferably provided between the lamp head and the lamp head neck. A flashlight constructed in this way can be produced simply and assembled quickly, which is primarily advantageous when the ring is to be connected to or removed from the flashlight. This is because the ring is preferably mounted with a form fit between the flashlight housing and the end cap or between the flashlight housing and the lamp head. In the case of the alternative refinement having a flashlight head and a lamp head neck, the ring can optionally also be arranged between these components. Furthermore, it is also possible for two rings to be fixed to a flashlight at different points.

According to a further preferred embodiment, the ring is L-shaped in cross section and has a flange that engages around the flashlight in the assembled state, while the other flange is designed as a stop face for the end of the end cap, of the flashlight housing or of the lamp head. This makes it possible to keep the flange that is used as a stop face as small as possible, in order that the components of the flashlight can be joined together virtually to such an extent as would be possible without the interposed ring, which means the function of the flashlight is not impaired. At the same time, the size of the contact face, that is to say the part that engages around the flashlight, is not restricted, which means that the optimal size of the ring and therefore of the contact face can be chosen freely.

According to a further preferred embodiment of the present invention, the ring is produced in one piece from aluminum or plastic, which reduces both the production costs and the weight of the flashlight.

The parts of the raised formations are preferably designed as contact faces; in the case of an aluminum ring, these parts can also be provided with a plastic coating, which means that the flashlight is effectively prevented from sliding away.

BRIEF DESCRIPTION OF THE DRAWING

Practical refinements and further preferred embodiments of the present invention will be explained below by using the figures, in which:

FIGS. 1*a* to *d* show different embodiments of an antiroll ring;

FIG. 1*e* is a cross-section through an antiroll ring;

FIG. 2*a* is an exploded view of a flashlight having an antiroll ring and

FIGS. 2*b* to 2*e* each show schematic views of flashlights having mounted antiroll rings.

SPECIFIC DESCRIPTION OF THE INVENTION

Figure 2C:
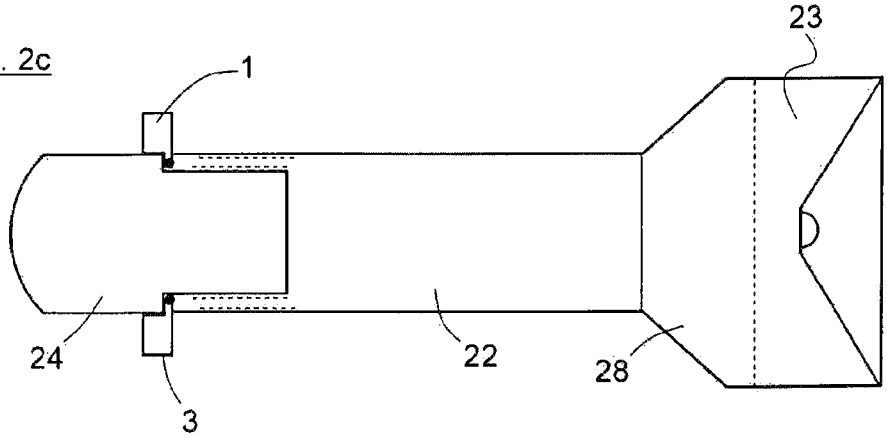

The ring 1 used as an antiroll device has a circular guide hole 2. The circumference of the ring 1 is configured so as to differ from a circular shape and has parts that are formed as a contact face 3. Different geometries of circumferential lines are provided, a polygonal configuration, as illustrated in FIGS. 1*a* and 1*b*, for example, being preferred. FIG. 1*a* shows an embodiment having six contact faces 3 and FIG. 1*b* one having ten contact faces 3. The fewer contact faces 3 are provided on a symmetrical ring 1, the greater is the width b of the contact faces 3, which means the support for the flashlight is comparatively more stable. However, given a configuration with comparatively few contact faces 3, the corners 4 are also more pronounced, which means the risk of damage to other objects is increased. Therefore, according to a preferred embodiment, the corners 4 can also be rounded off (arrow 5).

In addition to the substantially polygonal shape (FIGS. 1*a, b*), other designs of a ring 1 are also conceivable, for example those in which the contact faces 3 are formed by hemispherical or rib-like raised formations 5. Embodiments of this type are visually appealing and in addition give the user an improved feel.

The ring 1 is designed to be of L-section (FIG. 1*e*) and has an outer flange 6 that, in the assembled state (FIGS. 2*b* to 2*e*), surrounds the flashlight 21. To this end, the outer flange 6 has a radius R1 dimensioned such that it can be pushed onto a corresponding section of the flashlight 21. An inner flange 7 of the ring 1 is formed as stop faces 8, 8' for the parts of the flashlight 21 between which the ring 1 is supported by a form fit in the assembled state (FIGS. 2*b* to 2*e*). To this end, the inner flange 7 of the ring 1 has a radius $R_2$ dimensioned such that an angular stop face 8, 8' for the ends of the flashlight 21 is produced.

FIGS. 2*a* to 2*d* show various practical embodiments of a flashlight 21 provided with a ring 1, FIG. 1*a* showing an exploded view. The flashlights 21 have a substantially cylindrical shape and comprise a flashlight housing 22, a lamp head 23 and an end cap 24 that each have appropriate threaded sections 25, 25'. As illustrated in FIG. 2*a*, the ring 1 is dimensioned such that it can be slipped over the threaded section 25 in the direction of the arrow 26 until the stop face 8' is in contact with a stop face 27 on the end cap 24. By then screwing on the flashlight housing 22, the ring 1 is fixed with a form fit.

Figure 2D:
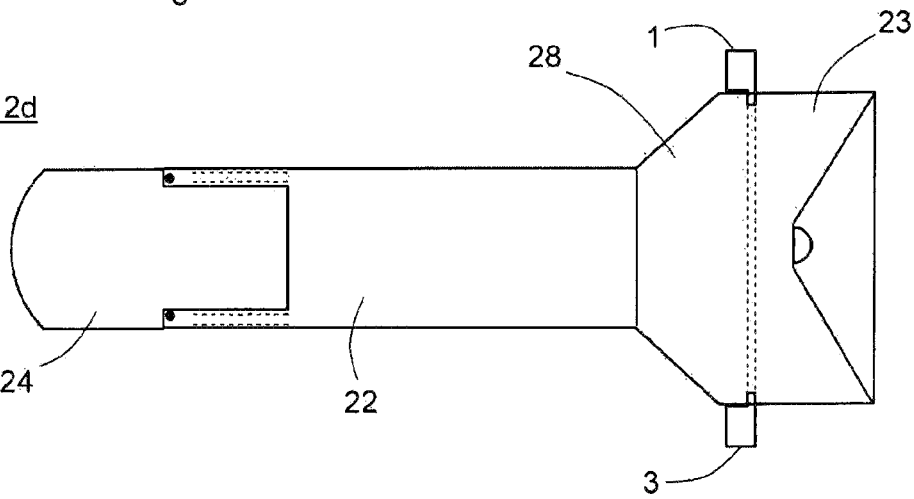
Figure 2E:
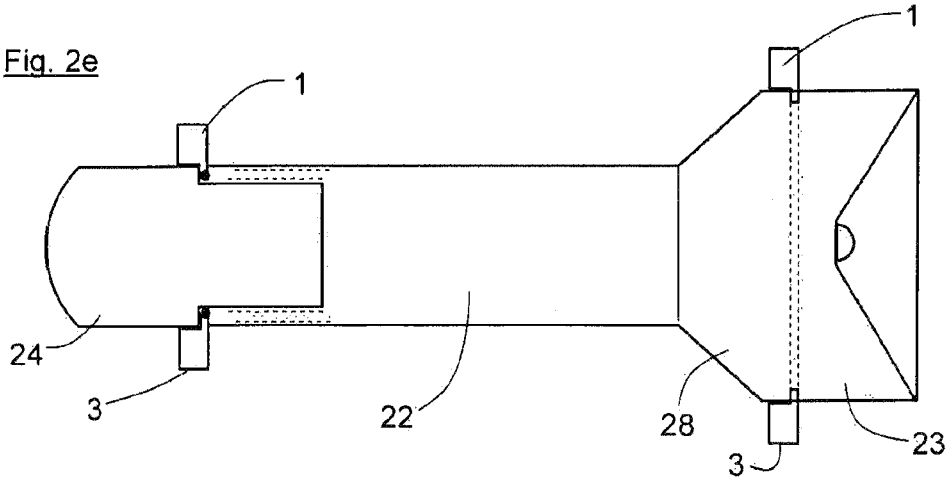

FIGS. 2*b* and 2*c* show different flashlights 21, each of whose ring 1 is mounted between the end cap 24 and the flashlight housing 22. The flashlight according to FIGS. 2*c* to *e* has a lamp head neck 28 in addition to the lamp head 23, between which a possibly comparatively larger ring 1 can likewise be arranged. FIG. 2*d* shows an embodiment having a ring 1 between the lamp head 23 and the flashlight neck 28, and FIG. 2*e* shows one in which one of the rings 1 is provided both between the lamp head 23 and the lamp head neck 28 and between the flashlight housing 22 and the end cap 24.

The invention claimed is:

1. A cylindrical flashlight comprising:

a housing having an end;

an end fitting forming an end cap or lamp head and fittable with the end of the housing;

interfitting screwthreads on the end fitting and on the end of the housing for screwing together the housing and the end fitting; and at least one ring detachably connected to the flashlight between the end fitting and the housing and having radially projecting raised formations having parts that are spaced from a surface of the cylindrical flashlight in some areas in an assembled state when the housing and end fitting are screwed together.

2. The cylindrical flashlight as claimed in claim 1, wherein the ring is of L-section and has an outer flange engaging around the flashlight in the assembled state and an inner flange forming stop faces engageable axially with ends of the end fitting and of the housing.

3. The cylindrical flashlight as claimed in claim 1, wherein a) the raised formations are designed to be hemispherical or semi-cylindrical, or b) the ring has a polygonal outer surface.

4. A ring for use as a antiroll device of a cylindrical flashlight comprising:

a housing having an end;

an end fitting forming an end cap or lamp head and fittable with the end of the housing; and interfitting screwthreads on the end fitting and on the end of the housing for screwing together the housing and the end fitting, the ring being detachably connectable to the flashlight and of L-section with an inner flange engaged between the housing and the end fitting and an outer flange having radially projecting raised formations having parts spaced from the cylindrical surface of the flashlight in an assembled state when the housing and end fitting are screwed together.

5. The ring as claimed in claim 4, wherein a) the raised formations are designed to be hemispherical or semi-cylindrical, or b) the ring has a polygonal outer surface.

6. The ring as claimed in claim 4, wherein the ring consists of aluminum or plastic in one piece.

7. The ring as claimed in claim 4, wherein the parts of the raised formations are designed as contact faces.

8. A flashlight comprising:

a housing extending along an axis and having an end;

an end fitting forming an end cap or lamp head and fittable with the end of the housing;

interfitting internal and external screwthreads on the end fitting and on the end of the housing for screwing together the housing and the end fitting; and an L-section antiroll ring having a radially inwardly projecting inner flange clamped axially between end faces of the fitting and of the housing when the end fitting is screwed to the housing and an outer flange extending axially from the inner flange and surrounding the housing or end fitting and formed with an array of radially outwardly projecting raised formations imparting a non-circular shaped to an outer surface of the outer flange.

* * * * *